US006308479B1

(12) United States Patent
Prohofsky

(10) Patent No.: US 6,308,479 B1
(45) Date of Patent: Oct. 30, 2001

(54) RAIN WATER DIVERTER SYSTEM FOR DECK STRUCTURES

(76) Inventor: Leroy A. Prohofsky, 8983 Ferndale La., Eden Prairie, MN (US) 55347

( * ) Notice: Subject to any disclaimer, the term of this patent is extended or adjusted under 35 U.S.C. 154(b) by 0 days.

(21) Appl. No.: 09/543,390

(22) Filed: Apr. 5, 2000

(51) Int. Cl.[7] ..... E04B 1/70

(52) U.S. Cl. ..... 52/302.1; 52/11; 52/127.5; 52/462; 52/478; 405/118; 405/119

(58) Field of Search ..... 52/11, 127.5, 462, 52/478, 302.1; 405/118, 119

(56) References Cited

U.S. PATENT DOCUMENTS

| | | | | |
|---|---|---|---|---|
| 1,562,346 | | 11/1925 | Leidich . | |
| 4,065,883 | | 1/1978 | Thibodeau . | |
| 4,129,967 | | 12/1978 | Barlow . | |
| 4,663,894 | | 5/1987 | LaRoche et al. . | |
| 4,789,116 | | 12/1988 | Eftestol . | |
| 4,858,399 | | 8/1989 | Salato, Jr. . | |
| 4,860,502 | | 8/1989 | Mickelsen . | |
| 5,511,351 | | 4/1996 | Moore . | |
| 5,765,328 | * | 6/1998 | Moore | 52/302.1 |
| 6,164,019 | * | 12/2000 | Salley | 52/11 |
| 6,226,956 | * | 5/2001 | Davis et al. | 52/745.06 |

OTHER PUBLICATIONS

*Underdeck* Brochure, (2 pgs.) 1999.
*Underdeck* Brochure, (6 pgs) 1999.

* cited by examiner

*Primary Examiner*—Beth A. Stephan
*Assistant Examiner*—Dennis L. Dorsey
(74) *Attorney, Agent, or Firm*—George H. Gerstman; Seyfarth Shaw

(57) ABSTRACT

A system for diverting rain water from the underside of a deck structure is comprised of a side-by-side array of flexible water-collecting elements , each of which collect and divert rain water from a regional area of the deck structure. Each water-collecting element is shaped to control the flow of water without restriction or impediment. This shape further increases the rigidity to the water-collecting element making it relatively easy to install and support. Coupling elements are interposed between adjacent water-collecting elements which function to fix them together such that the resulting array gains structural properties and impermeability comparable to a single corrugated sheet of the same material. Mounting elements secure this array to the underside of the deck. The result is an aesthetically attractive and environmentally rugged system which is realized with very economical components. Since there is no impediment in the flow path which would accumulate debris cleaning maintenance is seldom required. When cleaning maintenance is required it can be accomplished without disassembly. Nevertheless, the system is easily disassembled for repair maintenance.

10 Claims, 6 Drawing Sheets

12
14
15
16
18
20
21
22

42
41
40
10
30

40
41
42
10

44
41
45
46
43 d3
d2
d1
10
10
10
10
30
30

RAIN WATER DIVERTER SYSTEM FOR DECK STRUCTURES

FIELD OF THE INVENTION

The present invention relates generally to elevated decks for residential buildings, and more particularly to a rain water collection system for the underside of such decks to maintain a dry space beneath.

BACKGROUND OF THE INVENTION

Exterior deck structures, such as decks, gratings and walkways, are typically designed to allow water to fall through the spacing between adjacent decking boards or other apertures. It may be desirable to otherwise collect this water to thereby make the space under such surface dry.

A deck water collection assembly is disclosed in a pending application titled "Rain Water Diverter System for Deck Structures", Ser. No. 09/365,794, filed Aug. 3, 1999, by Richard A. Davis and LeRoy A. Prohofsky. A commercial embodiment of this pending application is marketed by the Underdeck Company of Minneapolis, Minn. The pending application discloses a system of convex collectors sheets alternating with concave gutters in an overlapping arrangement such that water dripping from the side edges of the collector drains into the gutters. This combination provides substantial advantages over other prior art in economy, attractiveness and ease of assembly/disassembly. These advantages are derived from a concept where the individual elements snap together to form an impermeable array. However, the coupling of collectors to gutters has inherent disadvantages. Particularly, the coupling of the pending application must be free to slip for easy disassembly and it must be discontinuous to allow water to drain from the collector to the gutter. If the gaps in the coupling are small, the system is susceptible to clogging at these gaps. If the gaps are large, the system is additionally susceptible to buckling. However it is configured, the coupling between collector and gutter is weak and contributes little to the rigidity of the system. This weakness must be overcome by measures which increase the cost of the system, e.g., thickening the collector to make it more rigid.

It is an object of the present invention to provide an impermeable assembly which may be easily mounted to the underside of existing decks, gratings or walkways, which collects and routes rain water to a discharge point while maintaining the area under the deck free of dripping water.

It is another object of the present invention to provide a rain water diverter system for deck structures using water collectors that do not require connection to gutters.

Another object of the present invention is to provide a rain water diverter system for deck structures that is easy to assemble.

A still further object of the present invention is to provide a rain water diverter system for deck structures that is relatively simple to manufacture and efficient in operation.

Other objects of the present invention will become apparent as the description proceeds.

BRIEF DESCRIPTION OF THE INVENTION

The instant invention improves upon the pending application by employing, in a preferred embodiment, a foldable and coilable element which is shaped such that it combines the functions of the prior collector and gutter. This new folded element can be joined into an array which is inherently more rigid and economical while presenting a seamless appearance. As will be described herein, substantial advantages accrue when the rain water is not required to flow from element to element and the elements are fixed together such that the resulting array gains structural properties and impermeability comparable to a single corrugated sheet of the same material.

In accordance with the present invention, a rain water collection apparatus, adapted to be affixed to an underside of an elevated, water pervious deck structure is provided. The collection apparatus comprises a plurality of water collectors for collecting rain water passing through the deck structure and for diverting the rain water to at least one end of the water collectors. A plurality of coupling elements are interposed between the side edges of adjacent pairs of the plurality of water collectors for joining the plurality of water collectors, to form an impervious water diverting array spanning the area of the deck structure. Mounting elements are provided for affixing the plurality of coupling elements to the underside of the deck structure.

In a preferred embodiment, the water collectors comprise a left generally vertical side region, a center convex region, and a right generally vertical side region. The coupling elements include a first cavity for receiving the left generally vertical side region of one of the pair of adjacent water collectors, and a second cavity for receiving a right generally vertical side region of the second pair of the adjacent water collectors. The coupling elements also include locking strips for securing the pair of adjacent water collectors to the coupling elements.

In an illustrative embodiment, the exposed surfaces of the coupling elements provide a decorative trim. The exposed surfaces of the coupling elements comprise a plurality of abutting segments extending continuously along a line spanning the deck structure.

In a preferred embodiment, each of the water collectors is foldable and coilable.

A more detailed explanation of the invention is provided in the following description and claims, and is illustrated in the accompanying drawings.

DETAILED DESCRIPTION OF THE ILLUSTRATIVE EMBODIMENT

Figure 1:
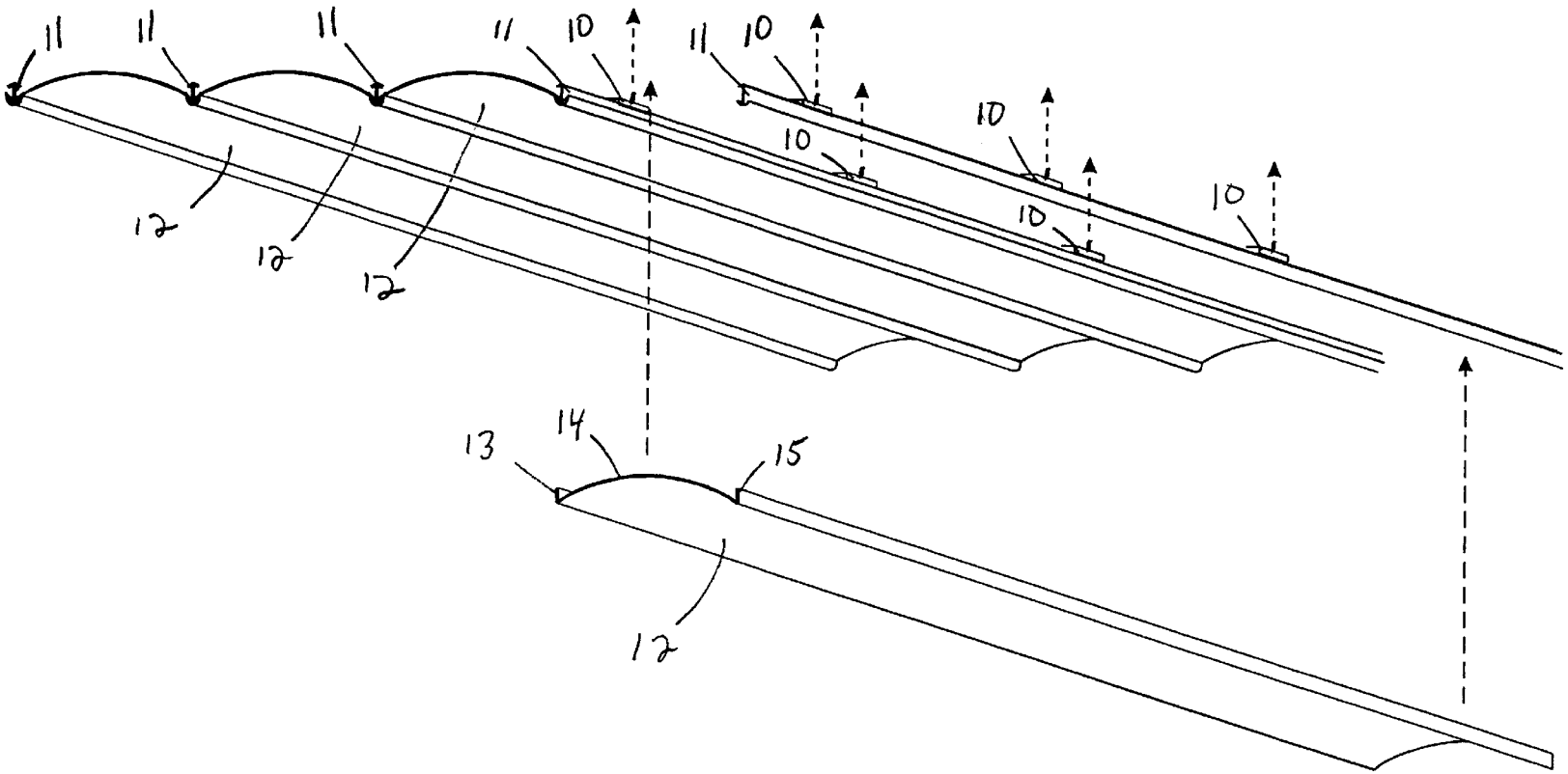
FIG. 1 is a bottom perspective view illustrative of a preferred embodiment of a rain-water diverting system comprised of a locked array of water-collecting elements 12.

FIG. 1 is a bottom perspective view illustrative of a preferred embodiment of a rain-water diverting system. It is comprised of mounting elements 10 which are fastened to the underside of a deck structure, not shown. Mounting elements 10, which are described with respect to FIGS. 4*a*–4*d* support coupling elements 11 which are described with reference to FIGS. 3*a*–3*c*. Water-collecting elements 12 are comprised of a left vertical side region 13, a convex center region 14 and a right vertical side region 15. This shape functions to first divert water transversely to the left and right sides and then longitudinally to at least one end as determined by the pitch of the water-collecting element. This also provides a smooth flowage path free of restrictions or impediments which could promote the accumulation of clogging debris. If there is any collection of debris at all it accumulates only at the side edges. Here it may be easily removed without any disassembly.

It is preferred that water-collecting element 12 be a continuous plastic foil capable of covering the span of a deck structure (usually 16 feet, or less). Since these lengths are difficult to transport, this is best accomplished by preforming features in the plastic foil, including crease lines which define the boundaries of the aforementioned left, center, and right regions. The crease lines make the element foldable, and thus coilable, such that it can be transported in a coiled form, uncoiled, cut to the desired length, and transformed to the desired shape.

Figures 2A, 2B, 2C, 2D, 2E:
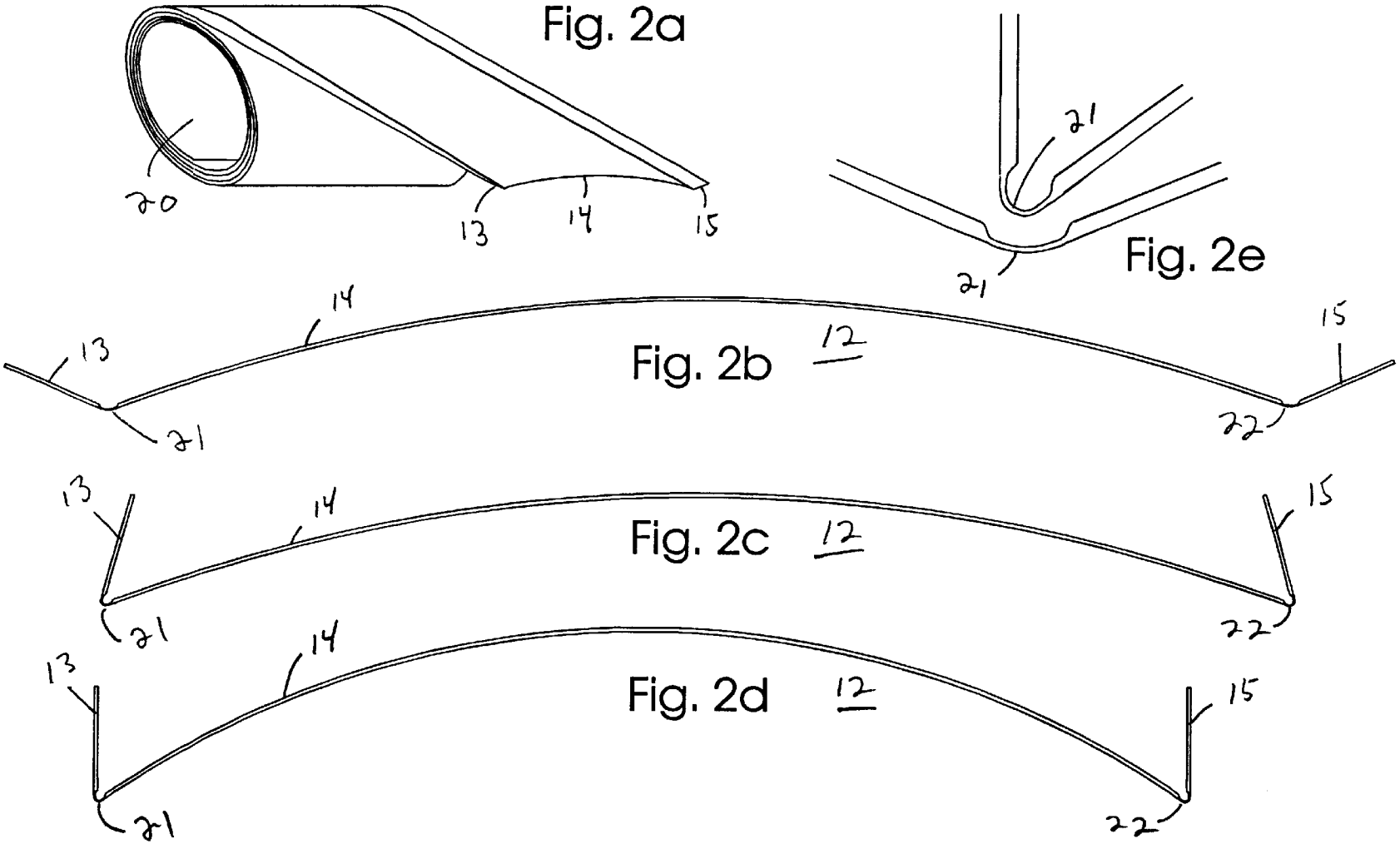
FIGS. 2*a*–2*d* show how water-collecting elements 12 are transformed from a coiled form to the installed shape.

FIGS. 2*a*–2*d* are illustrative of the transformation from coiled form to desired shape. FIG. 2*a* shows the coiled roll 20 from which desired length of water-collecting element 12 may be cut. Crease lines 21 and 22 define the left side region 13, center region 14, and right side region 15. Crease lines are preformed in roll 20 by making the local region of the crease substantially more pliable.

FIGS. 2*b*–2*d* are end views of water-collecting element 12 illustrative of the transformation steps. FIG. 2*b* shows the initial uncoiled shape of water-collecting element 12. Crease lines 21 and 22 have been formed by thinning the local region of the crease. In a preferred embodiment, the nominal thickness contemplated for element 12 is on the order of 0.025" while the thickness contemplated for the crease is 20–30% of this nominal value.

In FIGS. 2*a*–2*e*, the relative thickness has been exaggerated to more clearly illustrate the crease. The uncoiled shape of element 12, as shown in FIG. 2*b* is flatter than the desired shape being limited by the amount unrelieved stress remaining in the plastic after storage in the coiled form. That is, while the element 12 is stored in the coiled form it tends to progressively "forget" its pre-coiled shape as it relaxes toward a flat state. However, there is always a remnant memory of the pre-coiled shape and this memory aids in transforming the uncoiled element to its installed shape. The first transformation step is to fold element 12 as shown in FIG. 2*c* to form the vertical side regions 13 and 15 at the desired angle relative to center region 14. Next, element 12 is compressed to form the desired curvature of the convex center region 24 as shown in FIG. 2*d*. While this compression step may be directly accomplished by inserting element 12 into coupling element 11 it is advantageous to perform this step prior to insertion to increase rigidity and to facilitate installation. A tool for accomplishing this compression step is discussed with respect to FIG. 6.

Alternatively, water-collecting element 12 may be comprised of a plurality of overlapping segments having a convenient predetermined length. These shorter segments may be readily nested in a fully shaped configuration for transport thus eliminating the transformation steps of FIGS. 2*b*–2*d*.

Figure 3A:
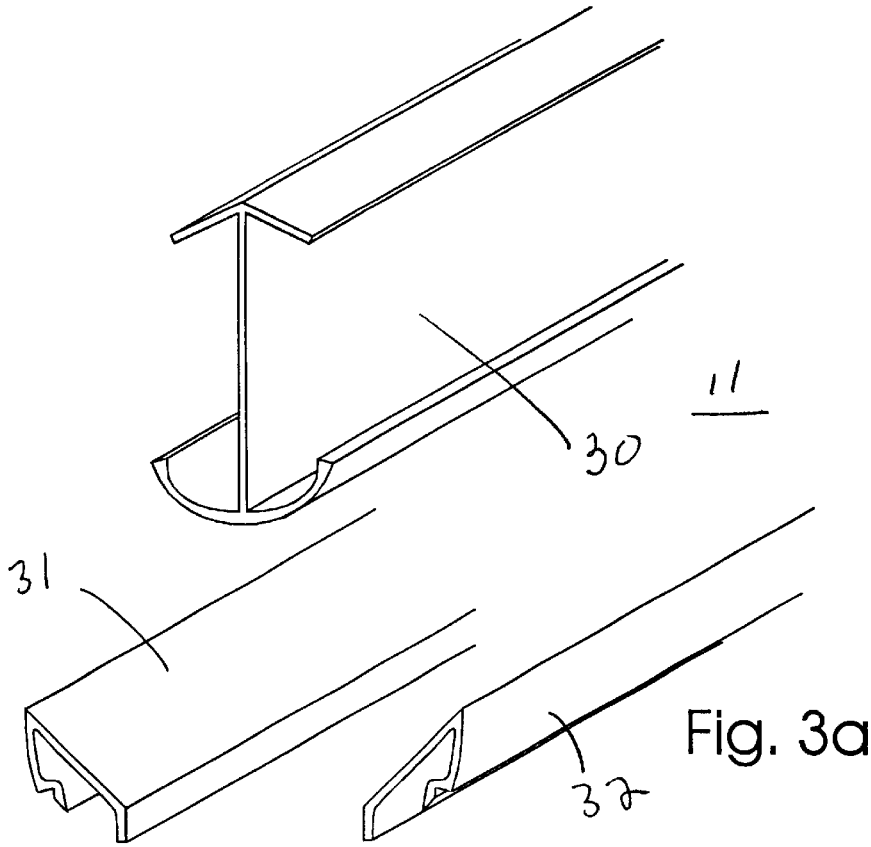
FIGS. 3*a*–3*c* show a preferred embodiment for coupling element 11.
Figure 3B:
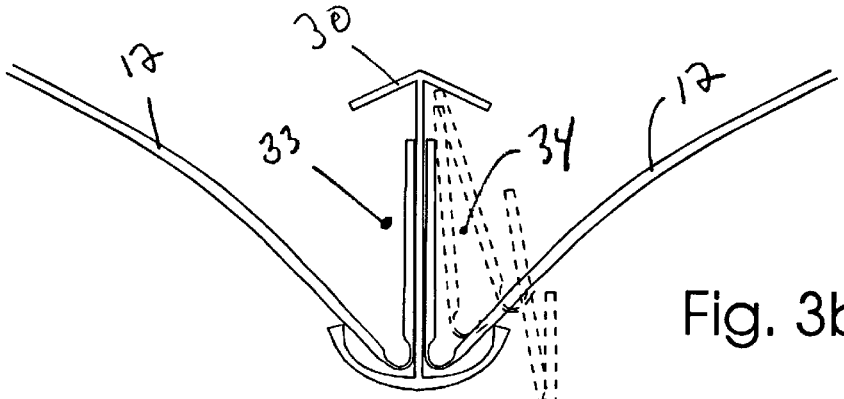
Figure 3C:
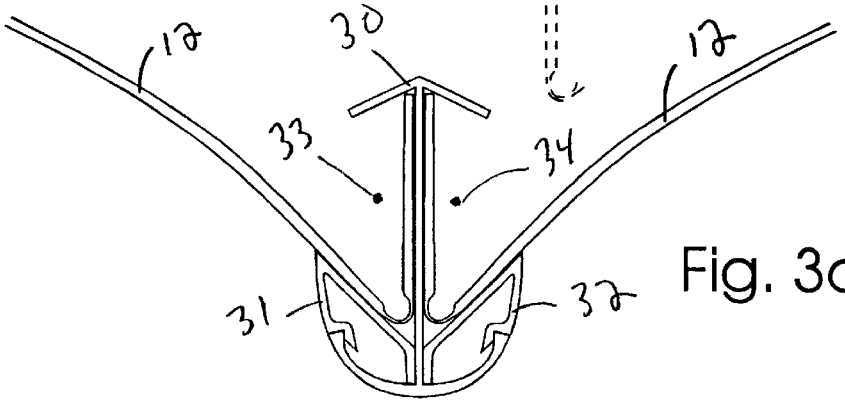

The details of a preferred embodiment of the coupling element 11 of FIG. 1 are shown in FIGS. 3*a*–3*c*. FIG. 3*a* shows isometric view of support rail 30 and locking strips 31 and 32 which collectively comprise coupling element 11. Conceptionally, each of these element is an extruded plastic component which extends the length of the system. More typically, they would be comprised of coupled segments as described with respect to FIG. 5. As shown in the end view of FIG. 3*b*, support rail 30 is configured with left and right cavities 33 and 34 to receive the side edges of adjacent water-collecting elements 12 without interference. As in FIGS. 2*a*–2*e*, the thickness of water-collecting element 12 has been exaggerated for clarity. In FIG. 3*b* the vertical side edges of water-collecting element 12 are shown resting at the bottom of support rail 30, as installed. The dashed lines are illustrative of the path traveled during installation. FIG. 3*c* is an end view showing locking strips 31 and 32 in the installed position. The locking strips snap into the locked configuration and remain there due to the compressive force of support rail 30, but can be easily removed without tools. The compression of the locking strips also assures a tight fit of the exposed surfaces giving the entire structure a seamless appearance. Water-collecting elements 12 are now effectively joined together, being captive in their respective cavities of a common structure. Water-collecting elements 12 may be formed of relatively thin material because this continuous joint precludes buckling or separation of the side edges.

The top edges of cavities 33 and 34 also prevent leakage of rain water at this junction. The exposed surfaces of support rail 30 and locking strips 31 and 32 collectively form a decorative trim which enhances the appearance of the system. Thus the coupling element 11 provides an aesthetically pleasing element for joining the water-collecting element into an impermeable array which has structural properties approximating those of the single corrugated sheet of plastic. The coupling of shaped elements enables a rugged and reliable system to be realized with relatively economical components.

FIGS. 4*a*–4*d* show a preferred embodiment of mounting element 10 of FIG. 1. As shown in cross-sectional end view FIG. 4*a*, mounting element 10 is comprised of a metal shell 40 and plastic spacer 41. These elements are secured to the underside of the deck structure, not shown, by deck screw 42. Support rail 30 is retained in the gap between shell 40 and spacer 41, being free to accommodate the longitudinal motion caused by thermal expansion and contraction.

Figures 4A, 4B, 4C, 4D:
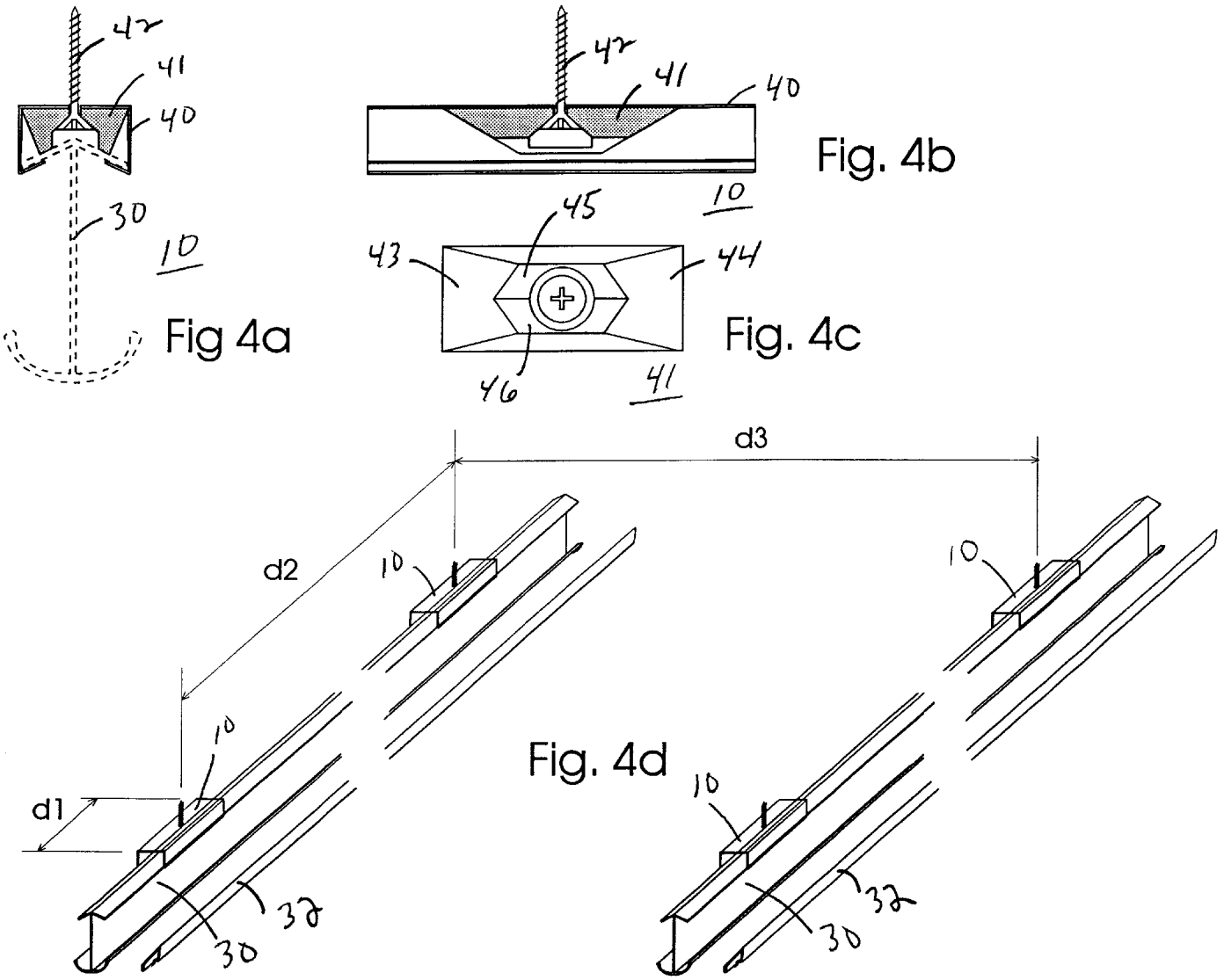
FIGS. 4*a*–4*d* show a preferred embodiment for attaching the rain-water diverting system to the underside of a deck structure.

FIG. 4*b* is a cross-sectional side view of mounting element 10 while FIG. 4*c* is a bottom view of spacer 41. These figures are provided to more clearly illustrate the geometry and function of spacer 41. With respect to FIG. 4*c*, the sloping surfaces 43 and 44 of spacer 41 serve to guide support rail 30 into its captive position in the mounting bracket during installation. Surfaces 45 and 46 contact the top surface of support rail 30 to prevent vertical movement. Alternatively, elements 40 and 41 may be combined into a single part.

FIG. 4*d* is a top isometric view illustrative of how the coupling elements may be secured to the under side of a deck structure. Distance d1 is chosen to distribute the load of support rail 30 over a distance sufficient to avoid distortion of the rail. Support brackets 35 may be positioned anywhere along support rail 30 commensurate with the availability of mounting sites on the underside of the deck. The spacing of support brackets along support rail 30, distance d2, may be relatively long due to the inherent rigidity of the coupled array of water collecting elements. Likewise the rail-to-rail spacing d3 may be chosen to correspond to the availability of mounting sites and the structural capability of the water collecting element. If d2 is chosen to be 32" and d3 is chosen to be 16 inches, the system could be attached to a deck of standard construction in either of two orientations. That is, the water-collecting elements may be oriented either parallel to, or orthogonal to, the deck joists.

The sequence of assembly of the system is as follows: Mounting elements 10 are attached to the underside of the deck in a grid having the spacings of d3 and d3. The vertical position of each mounting element is set by shims or spacers as required to establish the desired pitch. Next, support rails 30 are threaded through their respective mounting elements as shown in FIG. 4*d*. Finally, water-collecting elements 12 are set into support rails 30 and are secured by locking element 31 and 32.

Figure 5:
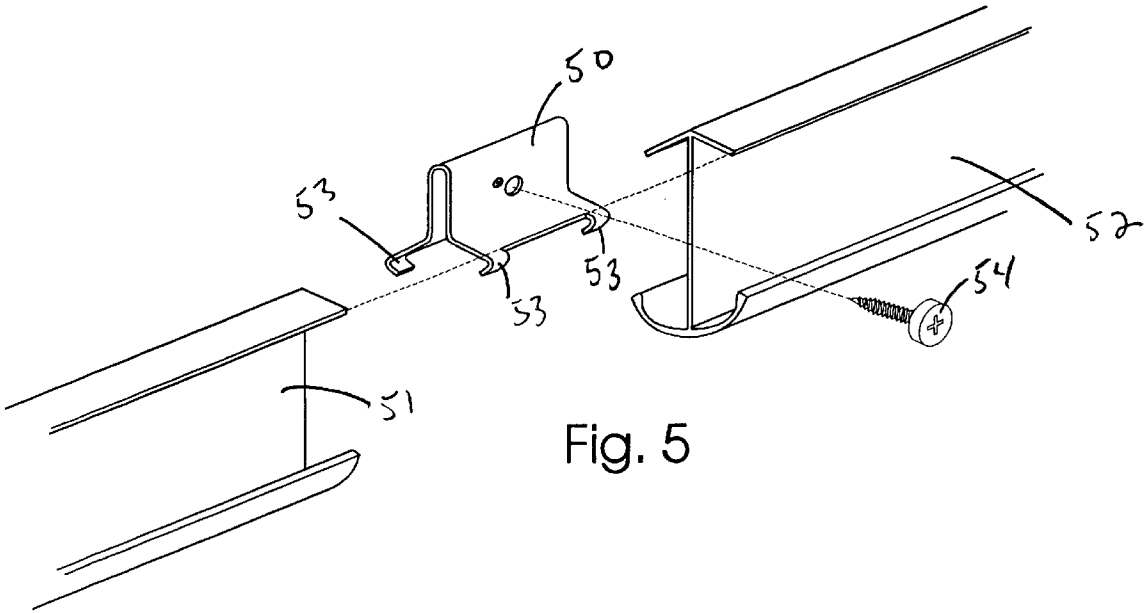
FIG. 5 shows a preferred embodiment for joining segments of the coupling means 12 of FIG. 3.

It is possible that thermal cycling could cause the segments of support rail 30 to creep apart thus presenting an unsightly gap. This possibility is precluded by joining the ends of abutting segments. FIG. 5 shows an isometric view of a metal clamping device which performs this function. Support rails 51 and 52 are mated end-to-end under clamp 50 such that a pair of opposing fingers 53 engage each support rail. Sheet-metal screw 54 causes a clamping action whereby each pair of opposing fingers 53 grip the support rails with a force sufficient to preclude relative movement. With this arrangement the locking strips are also prevented from creeping because they are now sandwiched between structures which expand and contract in synchrony, having substantially equal coefficients of thermal expansion.

Figure 6:
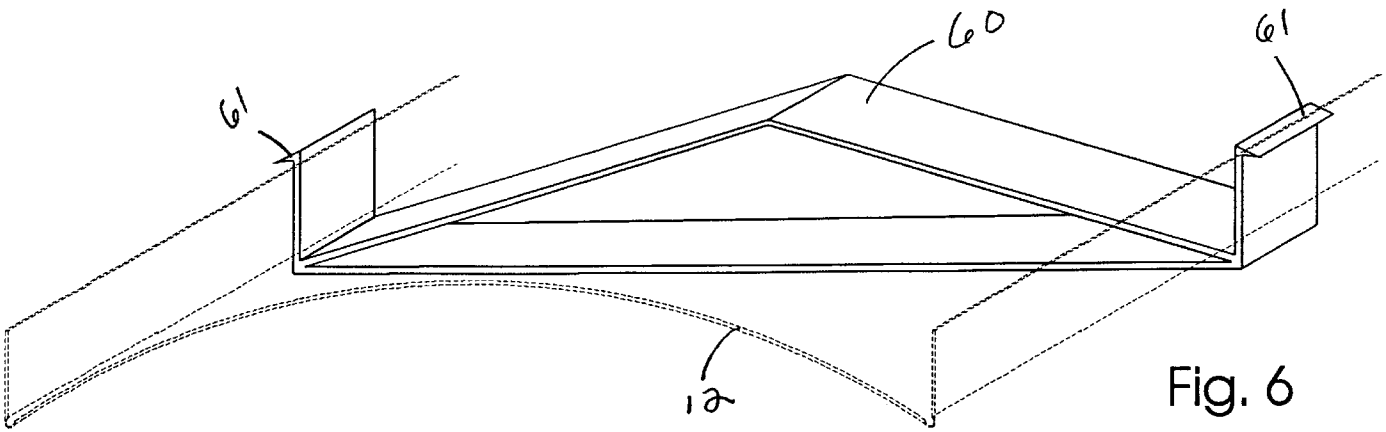
FIG. 6 shows a tool which facilitates the installation of water-collecting element 12.

FIG. 6 shows an installation tool 60 which facilitates installation. Tool 60 snaps on to water-collecting element 12, shown in dashed lines, to add shape as discussed with respect to FIGS. 2*a*–2*e*. A plurality of tools 60 spaced along the length of the water-collecting element improves rigidity making it easy for a single person to handle. Installation is further facilitated by projections 61 which allow the water-collecting element to be temporally suspended from the coupling element 11. From this position the transfer to the cavities of the coupling element is easily accomplished.

There are several ways to fabricate water-collecting element 12. For example, high-density polyethylene or other soft plastics may be deformed with pressure alone, or with a combination of heat and pressure, to form a very durable crease. Other more rigid plastics which would otherwise be superior may be susceptible to cracking or tearing at the crease. However, it is possible to incorporate rigid plastics into a multi-layer structure which is both relatively rigid and yet foldable. For example, a three-layer laminate comprising top and bottom layers of a thin flexible plastic such as Mylar® and a relatively thick (e.g. 1 mm) core of rigid foam plastic such as Sintra® would be inherently rigid and yet could be readily creased by locally crushing the foam core. Alternatively, it may be more economical to employ only a single narrow strip of thin strip of flexible plastic laminated to a rigid plastic such that the flexible strip itself functions as a hinge and protects the rigid foam plastic from cracking or tearing.

Figure 7B:
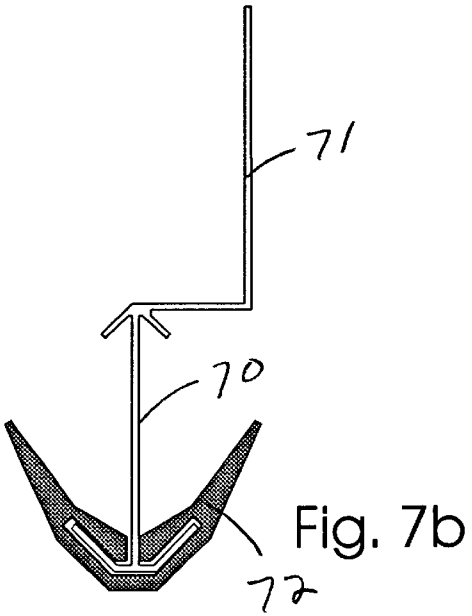
FIGS. 7*a* and 7*b* show an alternative embodiment for coupling adjacent water-collecting elements and attaching them to the underside of a deck structure.
Figure 7A:
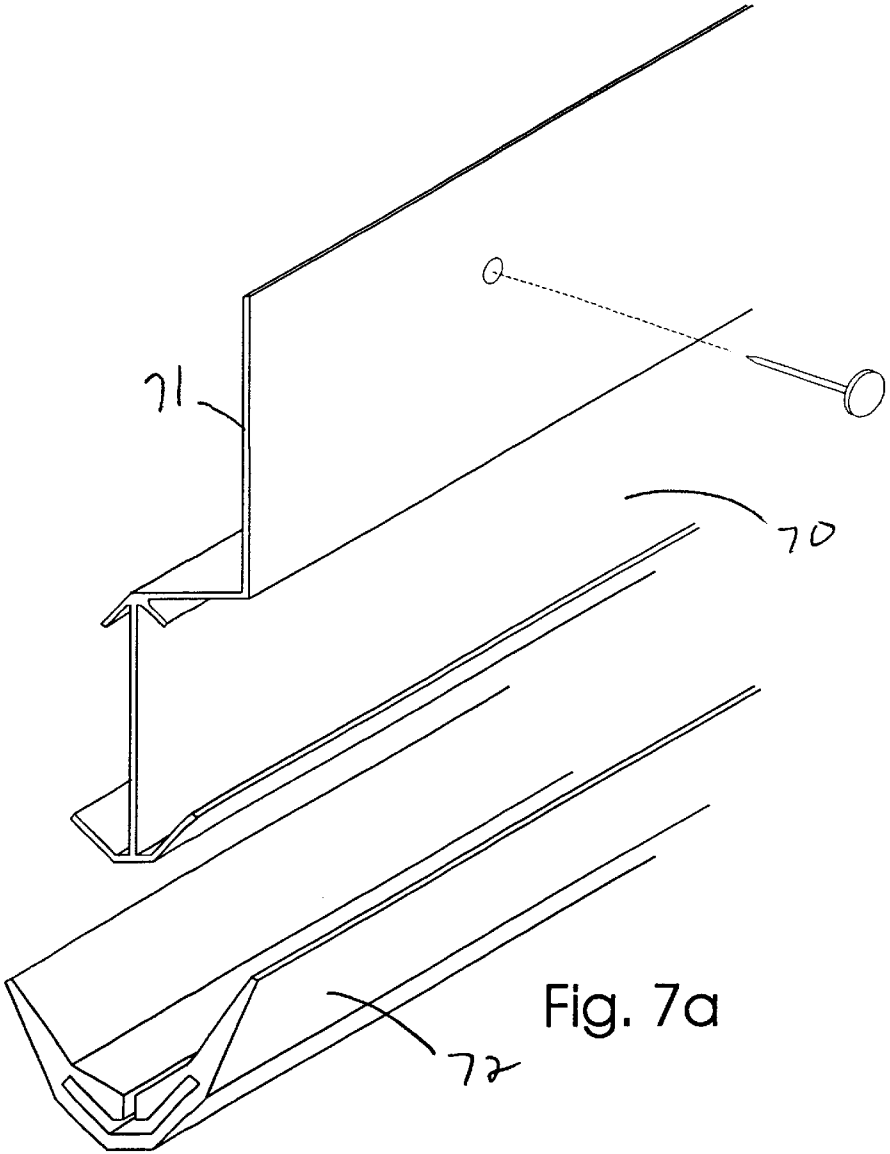

FIGS. 7*a*–7*b* are illustrative of an alternative embodiment of coupling element 11. Support rail 70 has all of the features of support rail 30 plus an extension which allows it to be nailed to the side of a deck joist, not shown. Locking strip 72 is threaded onto support rail 70 to provide the same function as locking strips 31 and 32 of FIGS. 3*a*–3*c*. However, unlike support rail 30, support rail 70 may have unseen gaps which are spanned by locking strip 71.

While the invention has been described with embodiments intended to drain rainwater from deck structures, the benefits of an aesthetically pleasing ceiling system which is inexpensive and very easy to install is also desirable for dry or interior applications. Any of the disclosed embodiments could be used without modification in dry or interior applications. Further, it is intended that any of the disclosed embodiments may be appropriately modified for dry applications where impermeability is not required or for interior applications where environmental stress is relatively low.

This invention has been described herein in considerable detail in order to comply with patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the spirit and scope of the invention.

What is claimed is:

1. Rain water collection apparatus adapted to be affixed to an underside of an elevated, water pervious deck structure, comprising:

(a) a plurality of water collectors for collecting rain water passing through said deck structure and for diverting said rain water to at least one end of said water collectors, said water collectors having side edges;

(b) a plurality of coupling elements, interposed between the side edges of adjacent pairs of said plurality of water collectors for joining said plurality of water collectors to form an impervious water diverting array spanning the area of said deck structure; and (c) mounting elements for affixing said plurality of coupling elements to the underside of said deck structure.

2. The apparatus of claim 1 wherein the water collectors comprises:

(a) a left generally vertical side region;

(b) a center convex region; and (c) a right generally vertical side region.

3. The apparatus of claim 2 wherein said coupling elements include:

a first cavity for receiving the left generally vertical side region of one of said pair of adjacent water collectors;

a second cavity for receiving the right generally vertical side region of the second of said pair of adjacent water collectors; and said coupling elements including locking strips for securing said pair of adjacent water collectors to said coupling elements.

4. The apparatus of claim 3 wherein said coupling elements include an exposed surface which provides a decorative trim.

5. The apparatus of claim 4 wherein said exposed surfaces of said coupling elements comprise a plurality of abutting segments for extending continuously along a line spanning said deck structure.

6. The apparatus of claim 2 wherein each of said water collectors is foldable and coilable.

7. The apparatus of claim 5 wherein each of said water collectors is foldable and coilable.

8. A system for diverting rain water from the underside of a deck structure, which comprises:

a side-by-side array of flexible water collecting elements;

each of said water collecting elements being adapted to collect and divert rain water from a regional area of the deck structure;

each of said water collecting elements being shaped to control the flow or water without restriction or impediment;

compressive locking strips interposed between adjacent water collecting elements to fix them together with a compressive fit, wherein each of said water collecting elements are separately detachable from said coupling elements and whereby the resulting array is water impermeable.

9. The system of claim 8, including mounting elements for securing the array to the underside of the deck.

10. A system for connecting rain water collection apparatus to an underside of an elevated, water pervious deck structure, which comprises the steps of:

(a) attaching mounting elements to the underside of the deck structure in a grid having predetermined spacings;

(b) connecting to said mounting elements a plurality of coupling elements, said coupling elements being adapted to receive a plurality of water collectors; and (c) connecting a plurality of water collectors to said coupling elements, whereby said water collectors are fixed together in a resulting array that is water impermeable.

* * * * *